United States Patent [19]

Okuyama et al.

[11] Patent Number: 4,966,547

[45] Date of Patent: Oct. 30, 1990

[54] HEAT TREATMENT METHOD USING A ZONED TUNNEL FURNACE

[75] Inventors: Takashi Okuyama, Taki; Yutaka Yamauchi, Matsusaka, both of Japan

[73] Assignee: Central Glass Company, Limited, Ube, Japan

[21] Appl. No.: 330,899

[22] Filed: Mar. 31, 1989

[30] Foreign Application Priority Data

Mar. 31, 1988 [JP] Japan ..... 63-79087

[51] Int. Cl.[5] ..... F27B 9/00

[52] U.S. Cl. ..... 432/9; 432/128; 432/12; 432/18; 432/45; 432/43

[58] Field of Search ..... 432/9, 12, 18, 43, 45, 432/128, 133, 136, 137, 140, 141, 153, 162, 164, 239, 242, 244, 246

[56] References Cited

U.S. PATENT DOCUMENTS

| | | | |
|---|---|---|---|
| 3,248,517 | 4/1966 | Vranken | 219/395 X |
| 3,261,596 | 11/1966 | Bowman | 432/48 |
| 3,463,465 | 11/1967 | Fuller | 432/48 X |
| 3,982,887 | 9/1976 | Kendziora et al. | 432/128 |
| 4,340,361 | 7/1982 | Tanaka et al. | 432/239 X |
| 4,518,353 | 5/1985 | Banno et al. | 432/162 X |
| 4,790,749 | 12/1988 | Mauro | 432/246 X |

*Primary Examiner*—Henry A. Bennet
*Assistant Examiner*—C. Kilner
*Attorney, Agent, or Firm*—Fleit, Jacobson, Cohn, Price, Holman & Stern

[57] ABSTRACT

The invention relates to the control of a tunnel furnace partitioned into a plurality of zones for heat treatment of, e.g., ceramic or glass workpieces. As usual the temperatures of the respective zones are controllable individually. Furthermore, in each of selected zones the temperature of that zone is varied from a first level to a second level during the stay of each workpiece in that zone and returned to the first level in a predetermined time after letting the workpiece out of that zone, and the length of stay of each workpiece in that zone is controlled such that another workpiece can be introduced into that zone while the preceding workpiece stays in the next zone and such that a number of workpieces can be heat treated in succession under the same time-temperature conditions.

6 Claims, 3 Drawing Sheets

HEAT TREATMENT METHOD USING A ZONED TUNNEL FURNACE

BACKGROUND OF THE INVENTION

This invention relates to a tunnel furnace partitioned into a plurality of zones with individual control of temperature and a method of making heat treatment of a plurality of, for example, glass or ceramic workpieces in the tunnel furnace.

Tunnel furnaces are widely used for heat treatment of various articles including glass and ceramic articles. The purpose of heat treatment may be firing, sintering or hot working such as bending of platy workpieces by utilizing softening of the heated workpieces. Usually workpieces to be passed through a tunnel furnace are placed on pallets, or molds in the case of heat bending, which are successively pushed into and out of the furnace. It is known, as shown in JP-A 47-25210 for instance, to partition a tunnel furnace into a plurality of zones by individually openable and closable shutters. Since each of the partitioned zones can be maintained accurately at a predetermined constant temperature it is possible to perform precision heat treatment of workpieces.

However, for heat treatment of glass or ceramic workpieces a tunnel furnace partitioned into constant temperature zones is not always convenient because in many cases it is necessary to raise or lower temperature in an intricate manner. For example, in the case of annealing workpieces of glass or a composite material containing glass it is necessary to perform gentle and precisely controlled lowering of temperature to suppress straining of the glass and relieve inevitably created some strains. If a zoned tunnel furnace of the aforementioned type is used for heat treatment of such workpieces the furnace must have many annealing zones each of which is maintained at a temperature only slightly lower than the temperature of the preceding zone. In the cases of ceramic workpieces attention has to be paid to the transformation points or transition points of the mineral materials of the ceramics because it is likely that rapid expansion or shrinkage occurs at each transformation or transition temperature and results in cracking or deformation of the workpieces. To prevent such phenomena it is necessary to interrupt heating or cooling of each workpiece at each transformation or transition temperature in order to maintain the workpiece approximately at that temperature for a length of time sufficient to uniform the temperature of every part of the workpiece. Therefore, the zoned tunnel furnace must include several zones specifically for maintaining the workpieces at the respective transformation or transition temperatures. Use of a tunnel furnace partitioned into too many zones is unfavorable for efficiency of the heat treatment operation.

SUMMARY OF THE INVENTION

It is an object of the present invention to provide a zoned tunnel furnace in which a plurality of workpieces, which may be made of ceramic or glass, can successively be heat treated efficiently and accurately.

It is another object of the invention to provide a method for efficiently and accurately making heat treatment of a plurality of workpieces in a zoned tunnel furnace in succession.

The present invention provides a tunnel furnace for heat treatment of workpieces, the furnace comprising a plurality of shutters arranged to partition the interior of the furnace into a plurality of zones which are in series and adjacent to each other, means for selectively opening and closing the shutters individually, in each of the zones conveying means for taking a workpiece into that zone and letting the workpiece out of that zone, the conveying means being operatable independently of the conveying means in the other zones, for each zone heating means for raising the temperature in that zone, and control means for controlling the operation of the heating means for each zone to vary the temperature of each zone in a predetermined manner in relation to time, or not to vary the temperature, and controlling the operation of the conveying means in each zone so as to control the length of stay of each work-piece in at least one of the zones.

In another aspect the invention provides a method of making heat treatment of a plurality of workpieces in succession by passing each workpiece through a tunnel furnace partitioned into a plurality of zones which are in series and adjacent to each other by selectively openable shutters, the method comprising the steps of controlling temperatures of the zones individually, controlling the length of stay of each workpiece in at least one zone of the furnace, and in each of said at least one zone varying the temperature of that zone from a first temperature to a second temperature during the stay of each workpiece in that zone and returning the temperature to the first temperature in a predetermined time after letting the workpiece out of that zone and before taking another workpiece into that chamber.

In preferred embodiments of the invention the length of stay of each workpiece in each of said at least one zone and the length of said predetermined time are controlled such that the sum of the length of stay and the length of the predetermined time is invariably constant in all of said at least one zone.

By controlling the temperature and the length of stay of each workpiece in each of the selected zones in the above stated manner, it has become easy to perform gentle annealing of glass or glass containing workpieces or temporarily interrupt heating or cooling of ceramic workpieces to avoid unfavorable influences of the transformation or transition of a mineral material of the ceramic. Furthermore, it has become possible to introduce a second workpiece into each zone of the furnace while the first workpiece stays in the next zone.

A zoned tunnel furnace according to the invention may have at least one zone wherein the temperature is maintained constant during the stay of each workpiece in that zone. Including such cases, it is preferable that the length of time, K given by the following equation, is invariably constant in all the zones of the furnace.

$$T_s + T_r = K$$

where $T_s$ is the length of stay of each workpiece in one zone of the furnace, and $T_r$ is the length of time in which the raised or lowered temperature in that zone is returned to the initial level. In the equation it is permissible that $T_r$ is zero so that K equals to $T_s$. When a long time is needed to carry out gentle annealing, the furnace may have a suitable number of annealing zones to thereby hold the above equation. Each zone wherein the temperature is raised during the stay of each workpiece may be provided with a hot air ejector or a cold air inlet to shorten the length of time needed to return the raised temperature to the initial level to thereby shorten the time length K in every zone of the furnace.

DESCRIPTION OF THE PREFERRED EMBODIMENTS

Figure 1:
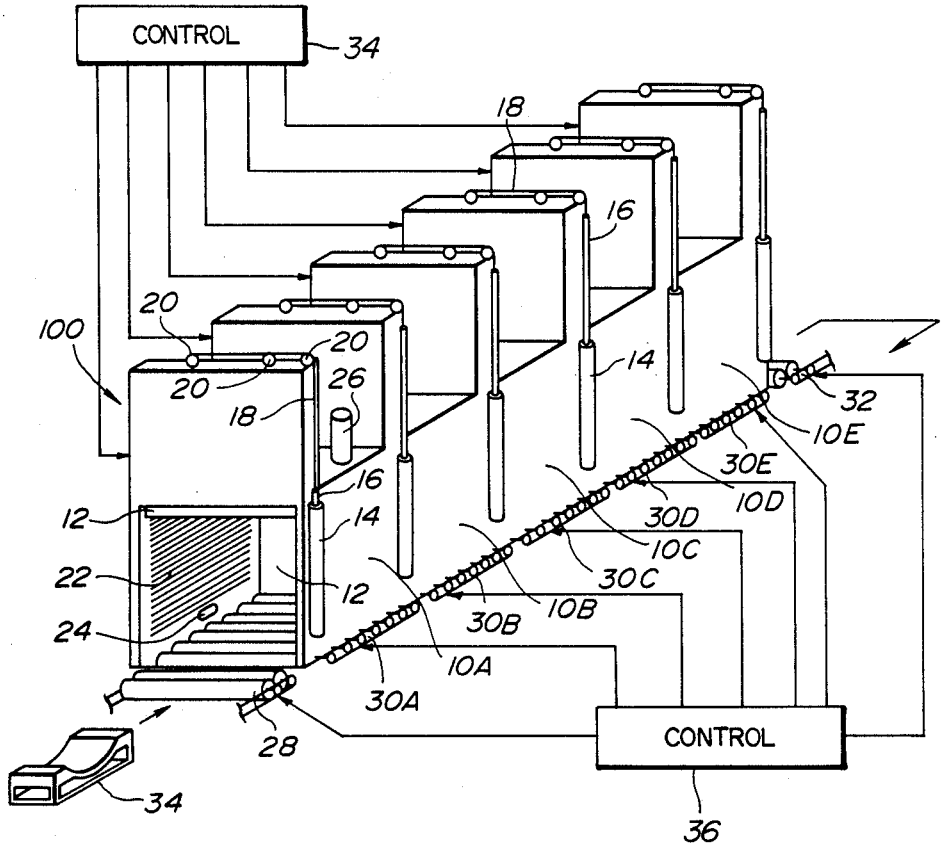
FIG. 1 is a schematic, perspective view of a zoned tunnel furnace in which the invention is embodied.

FIG. 1 shows a tunnel furnace 100 embodying the present invention. The furnace 100 is divided into five zones 10A, 10B, 10C, 10D and 10E by vertically movable shutters 12. For example, the zone 10A is used as a preheating zone, zone 10B as a heat working zone, zones 10C and 10D as annealing zones, and zone 10E as a cooling zone. For opening and closing each shutter 12 there is an air cylinder 14 with a vertically moving piston rod 16, and a heat-resistant wire 18 connects the shutter 12 to the piston rod 16 via pulleys 20. In each zone the furnace walls are provided with electric resistance heating wires 22, and the operation of the heaters 22 in each zone is under programmed control 34 independently of the heaters 22 in the other zones. According to the need, each or any of the zones 10A to 10E is provided with auxiliary means for lowering temperature and/or promoting lowering of temperature, such as cold air inlet 24 and/or hot air ejector 26.

Outside the furnace 100, a roller conveyer 28 extends to the entrance of the furnace to introduce workpieces (not shown) each placed on a pallet or a mold 34 into the furnace. At the bottom of the furnace 100, five sets of roller conveyers 30A, 30B, 30C, 30D and 30E are provided in the five zones 10A to 10E, respectively. The roller conveyer (30) in each zone can be driven independently of the roller conveyers in the other zones by control. Outside the furnace 100 another roller conveyer 32 extends from the exit of the furnace to transfer the heat treated workpieces to another station. Needless to mention, each of the roller conveyers 28, 30, 32 may be replaced by a different conveying means such as, for example, a reversible tracting mechanism using chains.

In this furnace 100, for example, heat bending of a plate of glass-ceramics is performed in the following way.

The glass-ceramics plate is placed on a mold 34 having a desirably curved surface, and the mold 34 is placed on the roller conveyer 28. Initially all the shutters 12 of the furnace 100 are closed, and the five zones 10A to 10E of the furnace are kept heated at predetermined temperatures, respectively. First the shutter 12 at the entrance of the zone 10A is opened, and the roller conveyer 28 and 30A are operated to introduce the glass-ceramics plate on the mold 34 into the zone 10A. Then the shutter 12 at the entrance is closed, and the glass-ceramics plate is kept under preheating within the zone 10A for a predetermined length of time. After that the shutter 12 between the zones 10A and 10B are opened, and the conveyers 30A and 30B are operated to transfer the preheated plate into the second zone 10B and the shutter is closed. In the zone 10B the glass-ceramics plate is further heated to soften and bend in conformance with the curved surface of the mold 34. After that, the worked glass-ceramics plate is annealed by gradual cooling in the zone 10C to a predetermined temperature and further gradual cooling in the next zone 10D. Thereafter the glass-ceramics plate is cooled in the zone 10E to near room temperature, and taken out of the furnace 100. After detachment of the worked glass-ceramics plate the mold 34 is returned to a predetermined station in front of the furnace 100.

During the above process the shutters 12 partitioning each zone are kept closed except when the glass-ceramics plate is being carried into or away from that zone. In the case of successively treating a plurality of identical workpieces under the same time-temperature conditions, the second workpiece can be introduced into the first zone 10A while the first workpiece is treated in the second zone 10B. While the first workpiece is kept in the third zone 10C the second workpiece can be carried into the second zone 10B, and then the third workpiece can be carried into the first zone 10A. Such a manner of operation is illustrated by the following Examples.

EXAMPLE 1

This example relates to the production of a silica base ceramic plate by firing a green plate in a furnace of the type shown in FIG. 1. The principal raw materials of the ceramic are cristobalite and quartz. The green plate was prepared by mixing powders of the principal raw materials with relatively small amounts of glass powder and lime milk used as binders, kneading the mixture and forming the kneaded mixture into the shape of a plate, followed by drying.

The furnace 100 is partitioned into five zones 10A to 10E with the intention of performing preheating in the zone 10A, firing (sintering) in the zone 10B, annealing in the zones 10C and 10D and final cooling in the zone 10E. With respect to each workpiece (ceramic plate) passed through the furnace 100 and referring to FIG. 2, the temperatures in the respective zones 10A to 10E are controlled in the manner as represented by the curve (I) in solid line. When the ceramic plate is heat treated under such programmed control of temperature, the temperature of the ceramic plate changes in the manner represented by the curve (II) in broken line. At about 200° C. transformation of cristobalite occurs, and at near 600° C. transformation of quartz occurs. Since the transformation of each of these principal raw materials is liable to cause expansion or shrinkage of the ceramic plate under heating or cooling, it is necessary to uniform the temperature of the ceramic plate in its surfaces and interior while the transformation of each material occurs. Therefore, the temperatures in the zones 10A and 10B are raised so as to remain approximately constant for an adequate length of time at each of the transformation temperatures, and the same consideration is given to the lowering of temperature in the zones 10C, 10D and 10E. Furthermore, in the zones 10C and 10D the temperature is very gently lowered in order to minimize creation of strains and not to retain strains in the glass regions of the fired ceramic plate.

Figure 2:
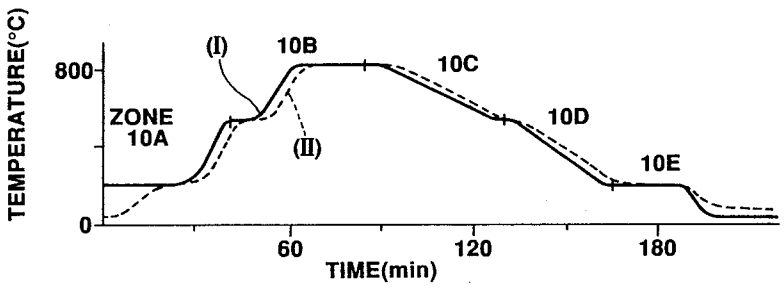
FIG. 2 is a chart showing the manner of controlling the temperatures of a ceramic plate subjected to sequential preheating, firing and annealing in the furnace of FIG. 1.
Figure 3:
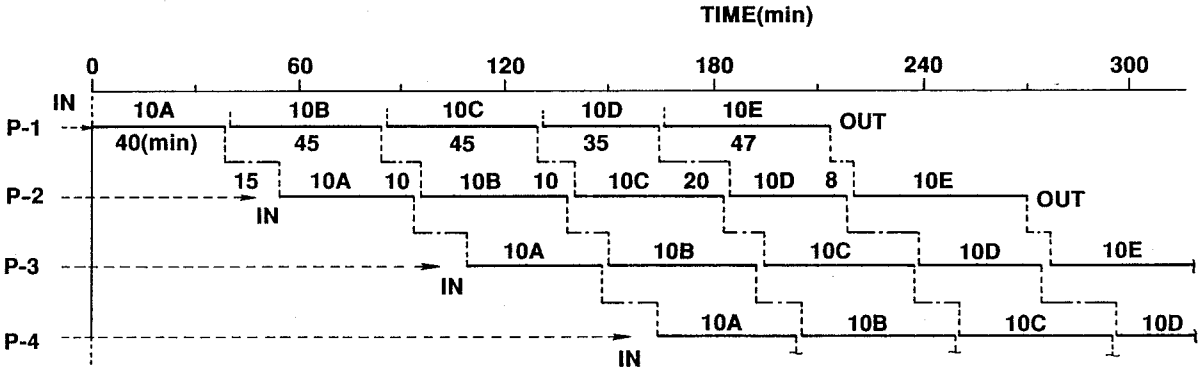
FIG. 3 is a diagram showing the lengths of the stay of each workpiece of the ceramic plate in the respective zones of the furnace with respect to four workpieces successively introduced into the furnace.

FIG. 3 is a diagram showing the program of heat treating four workpieces, P-1 to P-4, of the ceramic plate in succession. The solid line segments indicate the stay of the workpieces in the respective zones of the furnace, and the chain line segments indicate resetting of temperature in the respective zones. In the zone 10A the first workpiece P-1 is preheated up to 570° C. in 40 min (in the way as shown in FIG. 2) and immediately transferred into the zone 10B. In the zone 10B initially the temperature is maintained at 570° C. for 15 min, and in the following 30 min the temperature is raised to and maintained at 800° C. (in the manner shown in FIG. 2) to thereby accomplish firing of the workpiece. While the first workpiece P-1 is kept in the zone 10B, the zone 10A is cooled by interrupting the operation of the heaters 22, and using the hot air ejector 26 and/or cold air inlet 24 according to the need, so as to reset the temperature at the initial level of about 200° C. within 15 min. That is, the temperature in the zone 10A is controlled in the manner as shown in FIG. 4.

Figure 4:
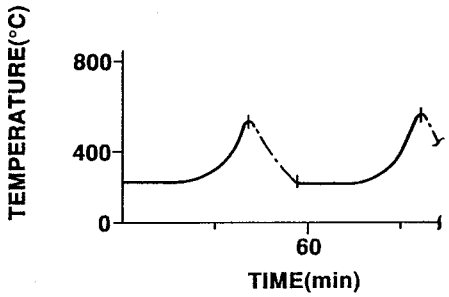
FIG. 4 is a chart showing the manner of raising and lowering the temperature of the first zone of the furnace in treating a plurality of workpieces in succession.

After the lapse of 55 min from the introduction of the first workpiece P-1 into the furnace the second workpiece P-2 is introduced into the first zone 10B, and the temperature in the zone 10A is raised in the manner shown in FIGS. 2 and 4. While the second workpiece P-2 is under preheating, the first workpiece P-1 is transferred from the firing zone 10B to the next zone 10C, and the temperature in the zone 10B is lowered to the initial level of 570° C. within 10 min. That is, at the end of the 40-min preheating of the second workpiece P-2 the next zone 10B is empty and maintained at 570° C. Therefore, the preheated workpiece P-2 can immediately be forwarded to the zone 10B, and after 15 min the third workpiece P-3 can be introduced into the zone 10A. In this way the operation proceeds as shown in FIG. 3 to treat each workpiece through the five zones 10A to 10E of the furnace. As will be apparent, all the workpieces P-1 to P-4 are treated under the same predetermined conditions and without interruption.

EXAMPLE 2

This example relates to heat bending of a plate of calcium silicate base glass-ceramics. In the furnace 100 of FIG. 1, the zone 10A is used as a preheating zone, the zone 10B as a working zone for heat bending, zones 10C and 10D as annealing zones and the zone 10E as the final cooling zone. With respect to each workpiece (glass-ceramics plate) and referring to FIG. 5, the temperatures in the respective zones of the furnace are controlled in the manner as represented by the curve (1) in solid line. The curve (2) in broken line represents the manner of changes in the temperature of the workpiece.

Figure 5:
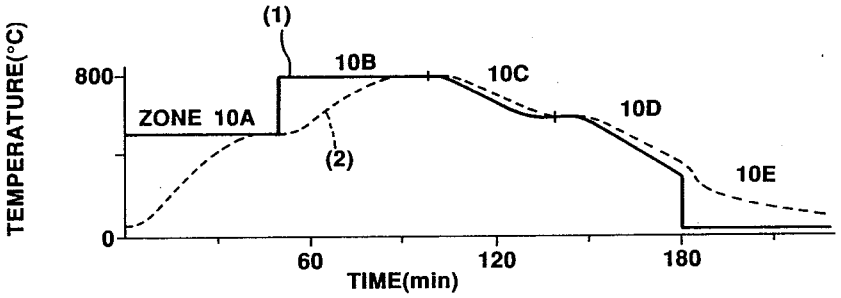
FIG. 5 is a chart showing the manner of controlling the temperature of a glass-ceramics plate subjected to sequential preheating, heat bending and annealing in the furnace of FIG. 1.
Figure 6:
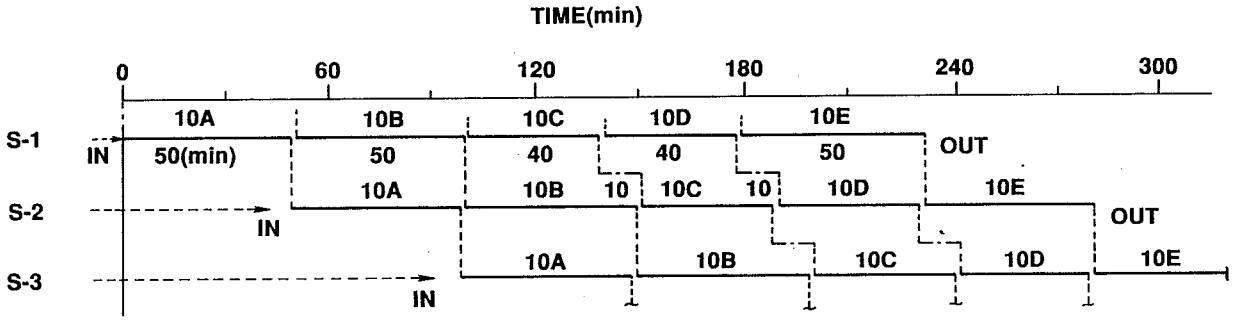
FIG. 6 is a diagram showing the lengths of the stay of each workpiece of the glass-ceramics plate in the respective zones of the furnace with respect to three workpieces successively introduced into the furnace.

FIG. 6 is a diagram showing the manner of heat treating three workpieces, S-1, S-2, S-3, of the glass-ceramics plate in succession. The solid line segments indicate the stay of the workpieces in the respective zones of the furnace, and the chain line segments indicate resetting of temperature in the respective zones. As can be seen in FIG. 5, in this case the preheating zone 10A and the working zone 10B are maintained constantly at 500° C. and 800° C., respectively. That is, it is not always a requisite to a zoned furnace according to the invention to raise or lower temperature of every zone during the stay of a workpiece in that zone. In the preheating zone 10A the temperature of the first workpiece S-1 rises up to 500° C. in 50 min. Then the workpiece S-1 is transferred into the working zone 10B maintained at 800° C., and immediately the second workpiece S-2 is introduced into the preheating zone 10A. After 50 min the first workpiece S-1 is forwarded to the annealing zone 10C and the second workpiece S-2 to the work zone 10B. In each of the annealing zones 10C and 10D the temperature is gradually lowered in 40 min and, after transferring the workpiece into the subsequent zone, reset at the initial level in 10 min. In the final cooling zone 10E the temperature is constant. In this way the operation proceeds as shown in FIG. 6, whereby all the workpieces are successively treated under the same predetermined conditions.

Needless to mention the foregoing examples are not limitative of the invention. The number of zones in the furnace is variable, and the temperature of each zone and the length of stay of each workpiece in each zone can be controlled in variously different manners depending on the purpose of heat treatment and the characteristics of the workpieces. As to workpieces, matters of great concern are usually dimensions, in particular thickness, and thermal properties such as thermal conductivity, heat capacity and crystal transformation temperatures. For example, in the case of treating workpieces which can be subjected to rapid heating without problem, it is possible to accomplish heating of each workpiece in any zone of the furnace by initially maintaining that zone at a temperature higher than the aimed temperature and lowering the temperature when the temperature of the workpiece nears the aimed temperature to thereby further enhance the efficiency of the heat treatment operation.

What is claimed is:

1. A method of heat treating a plurality of workpieces in succession by passing each workpiece through a tunnel furnace partitioned into a plurality of zones which are in series and adjacent to each other by selectively openable shutters, the method comprising the steps of:

controlling temperatures of each of said zones independently of the other of said zones;

controlling the length of stay of each workpiece in at least one zone of the furnace; and in each of said at least one zone, varying the temperature of that zone from a first temperature to a second temperature during the stay of each workpiece in that zone and returning the temperature of that zone to said first temperature in a predetermined time after letting the workpiece out of that chamber and before taking another workpiece into that zone, and in each of said at least one zone of the furnace the length of stay of each workpiece in that zone and the length of said predetermined time are controlled such that the sum of said length of stay and the length of said predetermined time is constant in all of said at least one zone.

2. A method according to claim 1, wherein said another workpiece is taken into each of said at least one of said zones immediately after letting said each workpiece out of that zone.

3. A method according to claim 1, wherein said workpieces are formed of a ceramic.

4. A method according to claim 1, wherein said workpieces are formed of a glass.

5. A method according to claim 1, wherein said workpieces are formed of a glass-ceramics.

6. A method of heat treating a plurality of workpieces in succession by passing each workpiece through a tunnel furnace, the tunnel furnace being partitioned into a plurality of zones in series and separate from each other by selectively openable shutters, the method comprising the steps of:

controlling the temperature of each of said zones independently of the other zones;

controlling the length of stay of each workpiece in each zone of the furnace; and varying the temperature of each zone from a first temperature to a second temperature during the stay of each workpiece in each zone and returning the temperature of each zone to said first temperature in a predetermined time after transferring the workpiece out of one zone to a successive zone and before transferring another workpiece into the one zone, and in each zone of the furnace, the length of stay of each workpiece in each zone and the length of said predetermined time are controlled such that the sum of said length of stay and the length of said predetermined time is constant for each zone and variable between different zones.

* * * * *